US007377293B2

(12) United States Patent
Fumex

(10) Patent No.: US 7,377,293 B2
(45) Date of Patent: May 27, 2008

(54) HEDDLE FRAME AND A LOOM FITTED WITH SUCH A FRAME

(75) Inventor: Andre Fumex, Talloires (FR)

(73) Assignee: Staubli Faverges, Faverges (FR)

( * ) Notice: Subject to any disclaimer, the term of this patent is extended or adjusted under 35 U.S.C. 154(b) by 41 days.

(21) Appl. No.: 11/259,072

(22) Filed: Oct. 27, 2005

(65) Prior Publication Data

US 2006/0090809 A1 May 4, 2006

(30) Foreign Application Priority Data

Nov. 3, 2004 (FR) ..... 04 11716

(51) Int. Cl.
*D03C 9/06* (2006.01)
*D03C 9/00* (2006.01)
*D03C 11/00* (2006.01)

(52) U.S. Cl. ..... 139/91; 139/92; 139/56; 139/82; 139/87

(58) Field of Classification Search ..... 139/91, 139/92, 56, 82, 87; 403/409.1, 359.3, 373, 403/370, 375
See application file for complete search history.

(56) References Cited

U.S. PATENT DOCUMENTS

| | | | | | |
|---|---|---|---|---|---|
| 1,701,520 | A | | 2/1929 | Walker | |
| 1,911,861 | A | | 5/1933 | Walker | |
| 2,090,110 | A | | 8/1937 | Cramer | |
| 2,336,869 | A | * | 12/1943 | Johnson | 410/140 |
| 3,414,022 | A | * | 12/1968 | Suhr | 139/92 |
| 3,889,721 | A | | 6/1975 | Wagner | |
| 4,112,980 | A | | 9/1978 | Bader | |
| 4,432,398 | A | * | 2/1984 | Root | 139/91 |
| 4,635,685 | A | | 1/1987 | Chabot | |
| 4,890,954 | A | * | 1/1990 | Richards | 403/260 |
| 4,924,916 | A | | 5/1990 | Faasse | |
| 5,560,399 | A | * | 10/1996 | Kramer | 139/91 |
| 5,630,448 | A | | 5/1997 | Faasse | |
| 5,887,629 | A | * | 3/1999 | Mettler et al. | 139/91 |
| 5,975,147 | A | * | 11/1999 | King et al. | 139/91 |

FOREIGN PATENT DOCUMENTS

| | | |
|---|---|---|
| BE | 342 808 | 7/1927 |
| FR | 1 193 366 | 11/1959 |
| FR | 2 213 360 | 8/1974 |

OTHER PUBLICATIONS

English language translation of earch report for European counterpart application (EP 05356192.4).
Search report for European counterpart application (EP 05356192.4).

* cited by examiner

*Primary Examiner*—Gary L. Welch
*Assistant Examiner*—Robert H Muromoto, Jr.
(74) *Attorney, Agent, or Firm*—Dowell & Dowell, P.C.

(57) ABSTRACT

A heddle frame having two uprights and two cross-rails interconnected by at least one brace extending in a direction generally parallel to the uprights. The brace includes a rod provided with a screw fastener at opposite ends thereof, two threaded members for being screwed onto one of the opposite ends of the rod, and first and second clamping members mounted to the opposite ends of the rod and the threaded members, respectively, for exerting a clamping locking force on a portion of each cross-rail wherein the locking force results from screwing the threaded members onto the opposite ends of the rod.

19 Claims, 5 Drawing Sheets

HEDDLE FRAME AND A LOOM FITTED WITH SUCH A FRAME

BACKGROUND OF THE INVENTION

1. Field of the Invention

The present invention relates to a heddle frame for a loom, and to a loom fitted with at least one such frame.

2. Description of the Related Art

In the field of weaving, it is known to use a heddle frame in which the top and bottom cross-rails are mounted on uprights that are parallel to the travel direction of the frame. Each cross-rail is fitted with a bar on which the ends of the heddles carried by the frame are threaded or hooked. The heddles must be capable of moving parallel to the longitudinal direction of the cross-rails in order to adapt their positions to the positions of the warp threads passing through them. To do this, the heddle-carrying bars must remain parallel and accurately spaced apart relative to each other, in spite of dynamic forces, in particular inertial forces, and in spite of static forces, in particular forces due to the warp threads being under tension, all of which are applied to the frame in operation.

In order to guarantee that the bars and the cross-rails remain spaced apart, it is known to use one or more braces that must be capable of being received in the empty volume between the cross-rails. A first technique consists in placing a rod between the cross-rails, which rod is secured to the facing sides of the cross-rails by strips through which screws pass. When action needs to be taken on such braces, in particular in order to adjust their positions along the cross-rails, the operator must take action on the cross-rails in zones that are difficult of access, thus making the work difficult and tiring, and increasing the risk of damaging the warp threads.

U.S. Pat. No. 5,975,147 teaches using a rod that is threaded at one of its ends and that has a drive head at its opposite end, the rod passing through the top cross-rail of a frame and being screwed into a socket secured to the bottom cross-rail. That rod is necessarily small in section since it must be operated in the space occupied by the frame, including in the vicinity of the heddle-carrier bars, thus requiring a flat to be formed on the rod, with such a flat weakening the rod. Creating a flat on a heddle-carrier bar requires the rod to have a particular angular orientation, which means that it is not necessarily screwed by an amount that matches the intended spacing between the cross-rails. Finally, the device for fastening the rod to the bottom cross-rail requires access on the heddle side, thus leading to the same tiring nature and risk of damaging the warp threads as in the above-mentioned device.

U.S. Pat. No. 4,924,916 teaches using a rod of small section, that is threaded at one of its ends and that carries a strip in the form of a rectangular parallelepiped at its other end. It is not possible to adjust the position of the threaded rod parallel to the longitudinal direction of the cross-rails. In addition, while the loom is in operation, opposing deformations of the cross-rails can lead to slack between the thread of the rod and the tapping in the strip, running the risk of inducing contact rust at that level.

SUMMARY OF THE INVENTION

The invention seeks more particularly to remedy those drawbacks by proposing a novel heddle frame fitted with a brace that ensures accurate relative positioning of the two cross-rails of a frame and of the heddle-carrier bars mounted on said cross-rails, while still being easier to adjust than is the case for prior art equipment.

To this end, the invention provides a heddle frame for a loom, the frame comprising two uprights and two cross-rails interconnected by at least one brace extending in a direction that is generally parallel to the uprights. This frame is characterized in that the brace comprises:

i) a rod provided in the vicinity of each of its ends with at least one screw fastener means;

ii) two members each suitable for being screwed onto one of the ends of the rod by co-operating with one of the screw fastener means; and iii) means suitable for exerting a locking force on at least a portion of each cross-rail, where the locking force is the result of screwing one of the members onto the corresponding end of the rod.

By means of the invention, the locking or clamping force that is obtained by means of the brace enables the portion of each cross-rail on which the force is exerted to be held stationary, both in terms of moving away from the other cross-rail and in terms of moving towards the other cross-rail. The two members can be driven from the outside faces of the cross-rails, thus making the work of an operator easier.

In an embodiment of the invention, the screw fastener means are tapped holes and the members are screws. In a variant, the screw fastener means are threads and the members are nuts.

In advantageous but non-essential aspects of the invention, such a frame may incorporate one or more of the following characteristics taken in any technically feasible combination.

- The portion of the cross-rail on which the locking force acts is a web or a projection inside the cross-rail. This web or projection is advantageously provided in the vicinity of a heddle-carrier bar fitted onto the cross-rail. By means of this aspect of the invention, the locking force that provides the relative positioning of the heddle-carrier bars carried by the two cross-rails is exerted in the immediate vicinity of the bars. Under such circumstances, the above-mentioned web or projection advantageously extends over the entire length of the cross-rail, which corresponds in particular to the situation in which the cross-rail is made as an extrusion of plastics material or of aluminum.
- The portion of the cross-rail on which the locking force acts is accessible, from the side of each cross-rail that faces towards the opposite cross-rail, via an opening formed locally in at least one external partition of the cross-rail.
- The means enabling the locking force to be exerted comprise, in the vicinity of each end of the rod: a first plate suitable for being pushed by the rod against the above-mentioned portion of the cross-rail; and a second plate suitable for being pushed by the corresponding member against the above-mentioned portion of the cross-rail, which portion is disposed between the plates. The plates thus serve to exert the locking force by being moved towards each other due to the corresponding member being tightened. Provision can be made for each first plate to be secured, in particular by welding, to the corresponding end the rod. Under such circumstances, and when the above-mentioned portion of the cross-rail is accessible through an opening as mentioned above, the opening is advantageously formed on one side only of the cross-rail, the zone for receiving the corresponding end of the rod being bordered by a tab form part of the cross-rail, the half-length of the first plate being greater than the distance between the tab and the central axis of the tapped hole in the end of the rod. By means of this aspect of the invention, the rod is prevented from turning by each first plate pressing against the adjacent tab of the cross-rail.

The above-mentioned means enabling the locking force to be exerted are adjustable in a direction parallel to the longitudinal direction of the corresponding cross-rail.

The rod is provided with at least one localized deformation going round a heddle-carrier bar. This aspect of the invention takes advantage of the fact that there is no need to turn the rod about its own axis in order to lock it in position using members which can themselves be made to turn about their own respective central axes.

In a first advantageous embodiment of the invention, each member extends to the outside of the cross-rail on which it is mounted, an opening being formed in the edge of the cross-rail that is remote from the other cross-rail, a lining being fitted on the second cross-rail in the vicinity of the opening, the lining contributing to preventing the member from moving in at least one direction perpendicular to the longitudinal axis of the member.

In another advantageous embodiment of the invention, the members do not project outside the cross-rails when they have been tightened, the members being accessible through orifices formed in the cross-rails.

The invention also provides a loom fitted with at least one heddle frame as defined above.

BRIEF DESCRIPTION OF THE DRAWINGS

The invention will be better understood and other advantages thereof will appear more clearly in the light of the following description of two embodiments of a frame in accordance with the principle of the invention and of a loom fitted with such a frame, given purely by way of example and made with reference to the accompanying drawings, in which.

DESCRIPTION OF THE PREFERRED EMBODIMENTS

Figure 1:
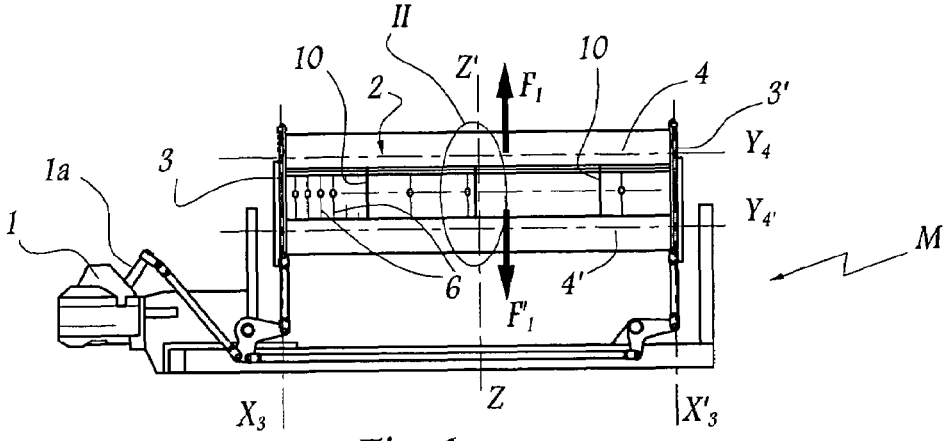
FIG. 1 is a diagram showing the principle of a loom in accordance with the invention.

In FIG. 1, a dobby 1 serves to drive a heddle frame 2 of a loom M with oscillating vertical motion represented by arrows $F_1$ and $F'_1$. To do this, an actuator arm 1*a* of the dobby 1 is connected via connecting rods and oscillating levers to the frame 2. The loom M comprises a plurality of frames, only one of which is shown in FIG. 1 in order to clarify the drawing.

In practice, the loom M can be used for weaving a cloth that is for use in works for manufacturing paper to support the paper pulp while it is drying. Under such circumstances, the frames 2 and their equivalents can number 56 and they can be of a length in excess of 10 meters (m).

Nevertheless, the invention is applicable to other types of frame.

Each frame 2 of the loom M is formed by assembling together two uprights 3 and 3' and two cross-rails 4 and 4'. The uprights 3 and 3' have their respective longitudinal axes $X_3$ and $X_3'$ generally parallel to the direction Z-Z' of vertical oscillation of the frame 2, while the cross-rails 4 and 4' have their respective axes $Y_4$ and Y4' generally perpendicular to the direction Z-Z' and to the warp threads of the loom M, these axes $Y_4$ and $Y_4'$ being in practice substantially horizontal when the loom is in its utilization configuration.

Each cross-rail 4 and 4' is fitted with a respective bar 5, 5' on which heddles 6 can be engaged, the heddles having eyes 61 enabling the height of the warp threads on the loom M to be controlled.

The cross-rail 4 is made as an aluminum extrusion with the bar 5 which is made of steel being fitted thereto. The same applies for the cross-rail 4'.

In a variant, the extrusions constituting the cross-rails 4 and 4' maybe made of synthetic material, preferably filled with reinforcing fibers.

A plurality of braces 10 are disposed between the cross-rails 4 and 4', with the number and relative spacing between the braces 10 being determined as a function of the length of the frame 2 and the stiffness of the cross-rails 4 and 4'.

Below, there follows a description of the structure and the functions of one brace. The structure and the functions of the other braces are identical.

Each brace 10 comprises a metal rod 11 extending between the cross-rails 4 and 4', and two screws or threaded members 12 and 12' respectively housed essentially in the inside volumes of the cross-rails 4 and 4'.

The top end 111 of the rod 11 is provided with a tapped hole 112 for receiving the threaded end 121 of the screw 12. Similarly, the bottom end 113 of the rod 11 is provided with a tapped hole for receiving the threaded end of the screw 12'.

A first clamping member or plate 14 is welded to the end 111, the plate being generally in the form of a parallelepiped with a central hole enabling the end 121 to be inserted into the tapped hole 112.

Figure 5:
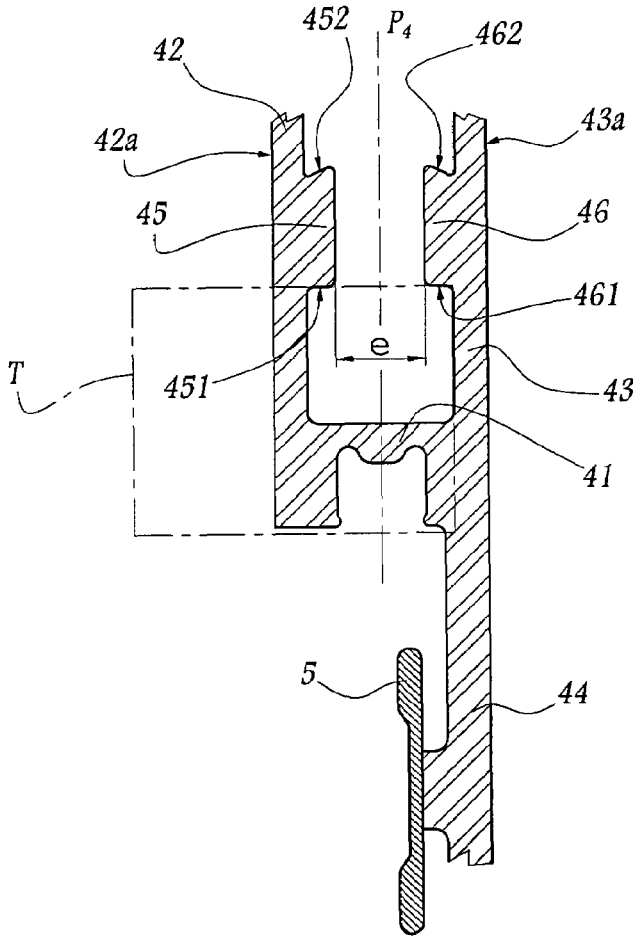
FIG. 5 is a fragmentary section on a larger scale on line V-V of FIG. 3.

As can be seen more particularly in FIG. 5, the extrusion constituting the cross-rail 4 is provided with a web 41 of width extending across the thickness of the cross-rail 4 and interconnecting a front partition 42 of the cross-rail 4 and a rear partition 43. The rear partition 43 is extended by a tab 44 to which the bar 5 is fitted.

Opposite from the bar 5 relative to the web 41, and on the inside faces of the partitions 42 and 43, the extrusion has two projections 45 and 46 facing each other and spaced apart by a gap of distance e.

To enable the brace 10 to be put into place in the cross-rail 4, an opening 47 is provided locally through the cross-rail by machining away a portion of the extrusion corresponding to the portion surrounded by chain-dotted line T in FIG. 5. Removing this material enables the end 111 of the rod 11 and the plate 14 it carries to be engaged until they make contact with the faces 451 and 461 of the projections 45 and 46 that face towards the bar 5.

An opening 47' similar to the opening 47 is formed in the cross-rail 4' for receiving the end 113 and the plate 14'.

In order to put the rod 11 into place, and given that the bar 5 projects laterally relative to the tab 44, the rod 11 is provided with a flattened portion 114 offset laterally relative to the longitudinal axis $X_{11}$ of the rod 11.

The midplane of the extrusion constituting the cross-rail 4 is referenced $P_4$, this midplane extending at equal distances from the outside faces 42*a* and 43*a* of the partitions 42 and 43. The offset nature of the portion 114 enables the axis $X_{11}$ to be put into alignment with the plane $P_4$ when the rod 11 is in place. In the vicinity of its end 113, the rod 11 is provided with a second offset portion 115 for going round the bar 5'.

The screw 12 is put into place by bringing its longitudinal axis $X_{12}$ into alignment with the axis $X_{11}$ of the rod 11, the axis $X_{12}$ then being parallel to the plane $P_4$ and perpendicular to the axis $Y_4$. The portion 121 is of diameter smaller than the gap e, thus enabling said portion to be engaged between the projections 45 and 46. The screw 12 is provided with a shoulder 122 which connects a portion of diameter $d_1$ terminating in the threaded end 121 to its main portion 123 that is not threaded, and that has a diameter $d_2$ greater than $d_1$. The value of $d_1$ is smaller than the value of e.

A second clamping member or plate 15 in the form of a rectangular parallelepiped provided with a central hole 151 is place around the portion 121 of the screw 12 and comes to bear against the shoulder 122.

To enable the screw 12 to pass towards the tapping 112 while the screw is fitted with the plate 15, an opening 481 is provided in the edge 48 of the extrusion 4 that is remote from the tab 44. The opening 481 is of dimensions that are greater than those of the plate 15 and it is made by machining the edge 48.

The extrusion 4 is also provided with internal stiffening splines 49, each of which is pierced by an opening 491 for passing the screw 11 fitted with the plate 15. The openings 491 are made by cutting or punching the splines 49.

By putting the screw 12 carrying the plate 15 into place, the elements 11 and 12 are screwed one in the other through the plates 14 and 15 and passing between the projections 45 and 46. The plate 15 thus comes to press against the top faces 452 and 462 of the projections 45 and 46.

When the plate 15 rests on the projections 45 and 46, it is possible to tighten the screws 12 in the tapped hole 112 by acting on its head 124 which projects outside the extrusion 4 through the opening 481.

This tightening has the effect of applying a force $F_3$ directed towards the bar 5 on the projections 45 and 46. By reaction, the end 111 of the rod 11 fitted with the plate 14 creates a force $F_4$ directed towards the edge 48. Thus, tightening the screw 12 in the end 111 of the rod 11 has the effect of clamping the projections 45 and 46 between the plates 14 and 15 by a force equal to the sum of the forces $F_3$ and $F_4$. This locking or pinching force $F_3+F_4$ enables the portion of the extrusion constituting the cross-rail 4 to be held firm in the immediate vicinity of the bar 5.

Figure 3:
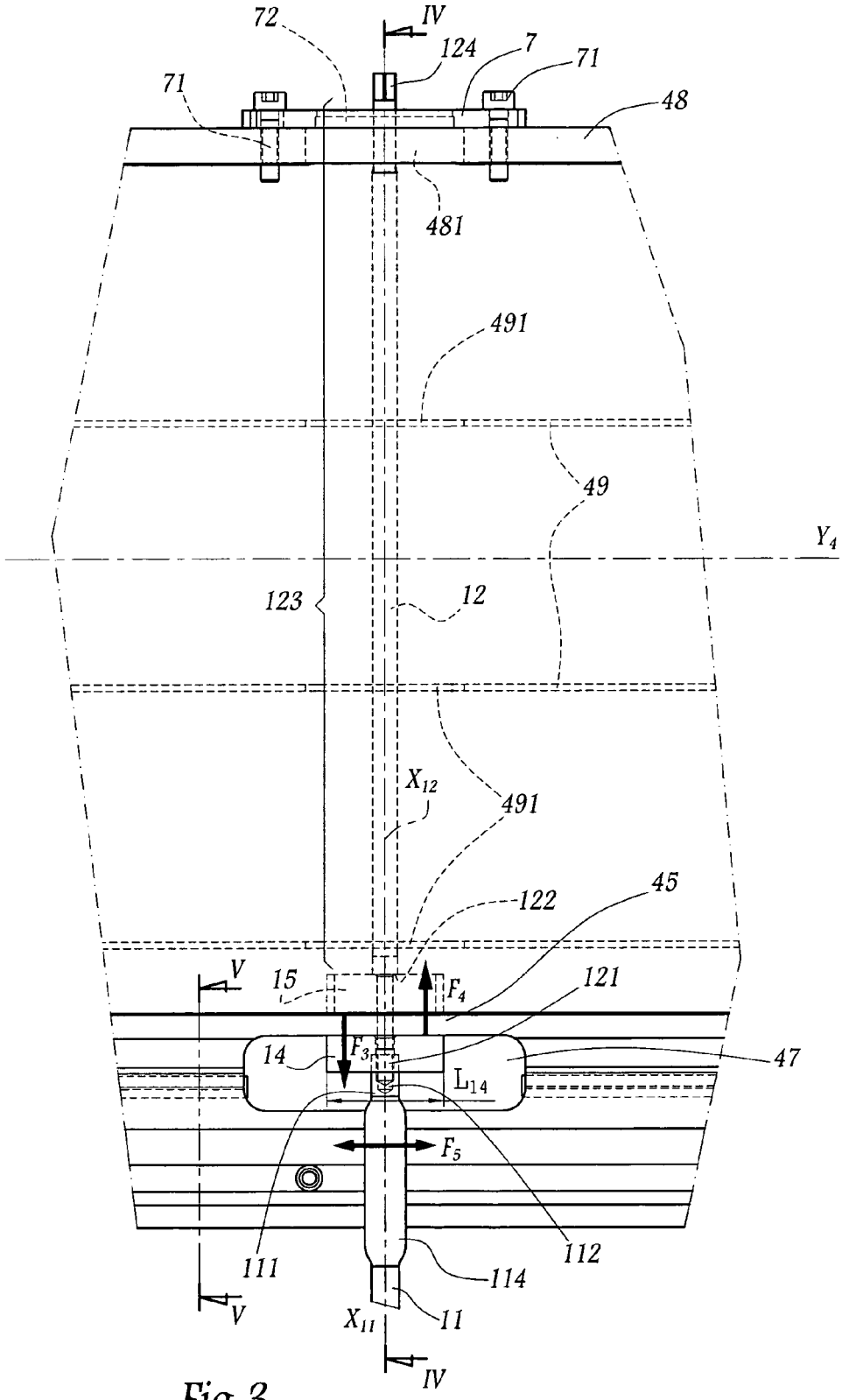
FIG. 3 is a view on a still larger scale showing a detail III of FIG. 2, with the elements that are internal to the top cross-rail of the frame being drawn in dashed lines.

In FIG. 3, the forces $F_3$ and $F_4$ are shown as being offset from each other in order to clarify the drawing. In practice, these forces are taken up over the lengths of the plates 14 and 15, and their resultants are substantially in alignment with the axes $X_{11}$ and $X_{12}$, which coincide.

Figure 2:
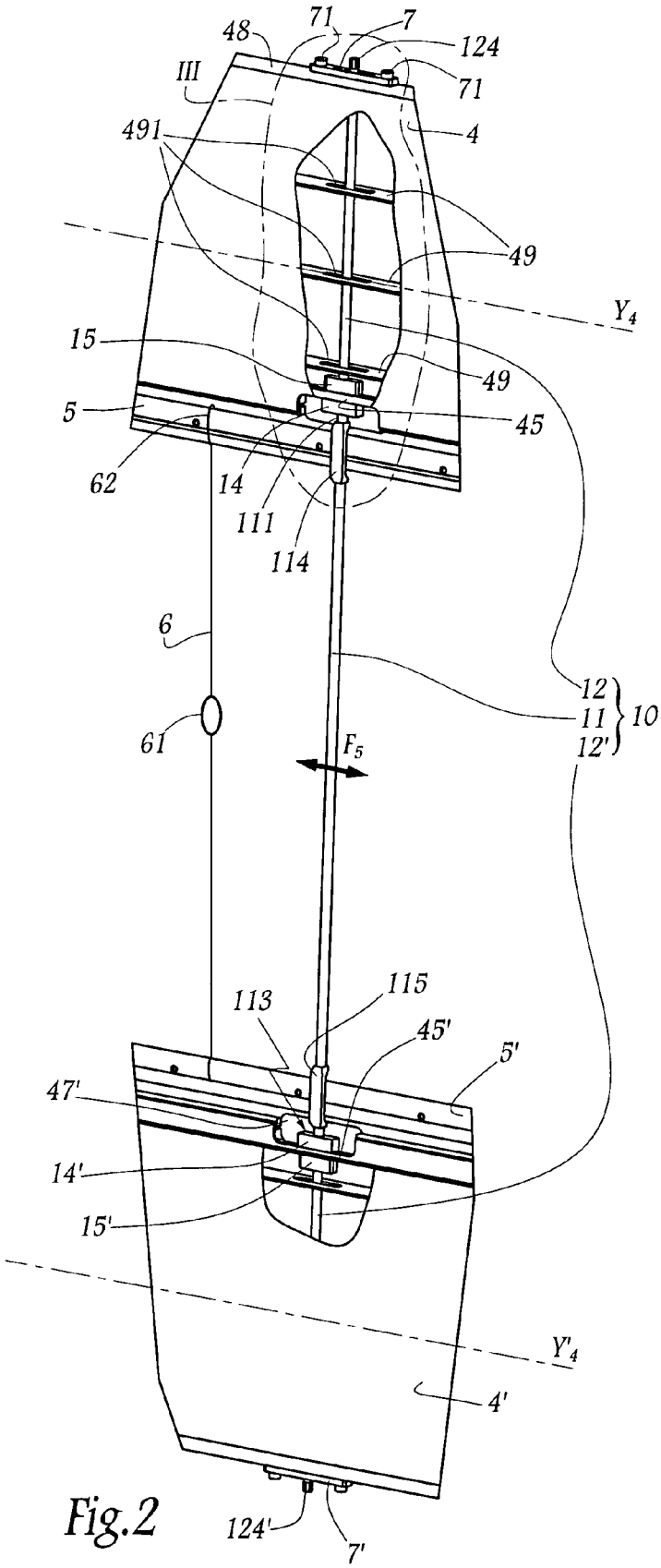
FIG. 2 is a perspective view, on a larger scale and partially cut away, showing a detail II of FIG. 1.

The assembly made at the bottom end 113 of the rod 11 with the screw 12' is analogous, the end 113 being fitted with a first plate 14' while the screw 12' is fitted with a second plate 15' enabling two projections to be clamped together, one of which can be seen in FIG. 2 under the reference 45'. A clamping force on the internal projections of the cross-rail 4' is thus obtained at the bottom portion of the rod 11.

The components $F_3$ and their equivalents of the locking forces exerted by the plates 15 and 15' oppose the bars 5 and 5' moving apart, whereas the components $F_4$ and their equivalents of the locking forces exerted by the plates 14 and 14' oppose these bars moving towards each other. The bars 5 and 5' are thus held at a constant and predetermined distance apart from each other, which makes it easier to install and slide the heddles 6 parallel to the axes $Y_4$ and $Y_4'$.

Given the way in which the rod 11 and the screws 12 and 12' are assembled, the position of the rod 11 parallel to the axes $Y_4$ and $Y_4'$ is easily adjustable, as represented by double-headed arrow $F_5$, insofar as it suffices to loosen the screws 12 and 12', from above the cross-rail 4 and from below the cross-rail 4' in order to cause the rod 11 to slide.

Figure 4:
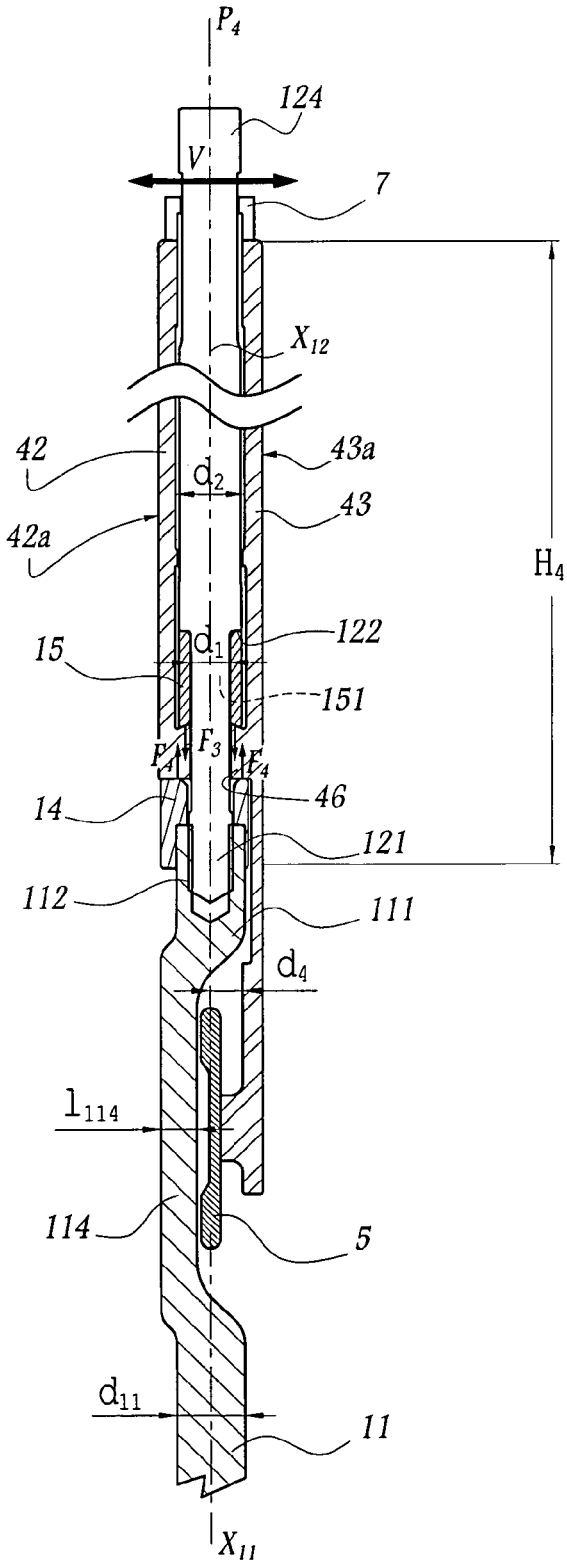
FIG. 4 is a section on line IV-IV of FIG. 3.

To prevent the screw 12 from vibrating while the frame 2 is oscillating, a screw-guide plug 7 is fitted to the edge 48 by means of two screws 71. This plug is provided with an oblong opening 72 of major dimension parallel to the axis $Y_4$, through which the non-threaded portion 123 of the screw 12 passes. The plug serves to prevent vibration at the end of the non-threaded portion 123 in the vicinity of the head 124 in a direction that is perpendicular to the plane of FIG. 3. The direction of this vibration is represented by double-headed arrow V in FIG. 4.

An analogous plug 7' is mounted on the cross-rail 4' in the vicinity of the head 124' of the screw 12'.

The brace 10 is put into place without it being necessary to turn the rod 11 about its own axis $X_{11}$, which means that the portions 114 and 115 can be relatively massive, and thus strong, without running any risk of deforming the bars 5 and 5'. In fact, the portion 114 may be of relatively great width $l_{114}$, providing it does not project beyond the face 42 of the cross-rail 4 once it is in place. For example, the width $l_{114}$ may be about half the diameter $d_{11}$ of the rod 11. The same applies for the portion 115.

Because the projections 45 and 46 are held by being clamped, the material constituting the extrusion forming the cross-rail 4 is caused to work in compression, which is favorable, and the clamping that is obtained is both strong and localized.

In this respect, the plates 14 and 15 and their equivalents enable the forces $F_3$ and $F_4$, i.e. the clamping force, to be distributed over the areas of their respective facing faces.

The length of the face 14 parallel to the axis $Y_4$ when the brace 10 is in its mounted configuration is written $L_{14}$. The distance between the axis $X_{11}$ and the tab 44 of the cross-rail 4 when the end 111 of the rod 11 is in place is written $d_4$. In practice, the axis $X_{11}$ is a central axis for the tapped hole 112. The half-length $L_{14}/2$ of the plate 14 is greater than the distance $d_4$, thus ensuring that, by bearing against the tab 44 beneath the projection 46, the plate 14 constitutes a device for preventing the rod 11 from turning, including while the screw 12 is being tightened. Thus, there is no need to intervene in the vicinity of the top ends 62 of the heddles 6 when it is appropriate to adjust the longitudinal position of a brace 10, insofar as action on the head 124 provides full control over loosening and then tightening the screw 12.

The same applies for adjusting the position of the end 113 parallel to the axis $Y'_4$.

The height $H_4$ of the cross-rail 4, i.e. its dimension parallel to its travel direction as controlled by the dobby 11, is greater than the travel stroke of the frame 12, thus making it possible to omit using guide caps as are commonly implemented in certain looms. The frames can be guided relative to one another by guide plates stuck locally onto the extrusions constituting the cross-rails 4 and 4'.

Figure 6:
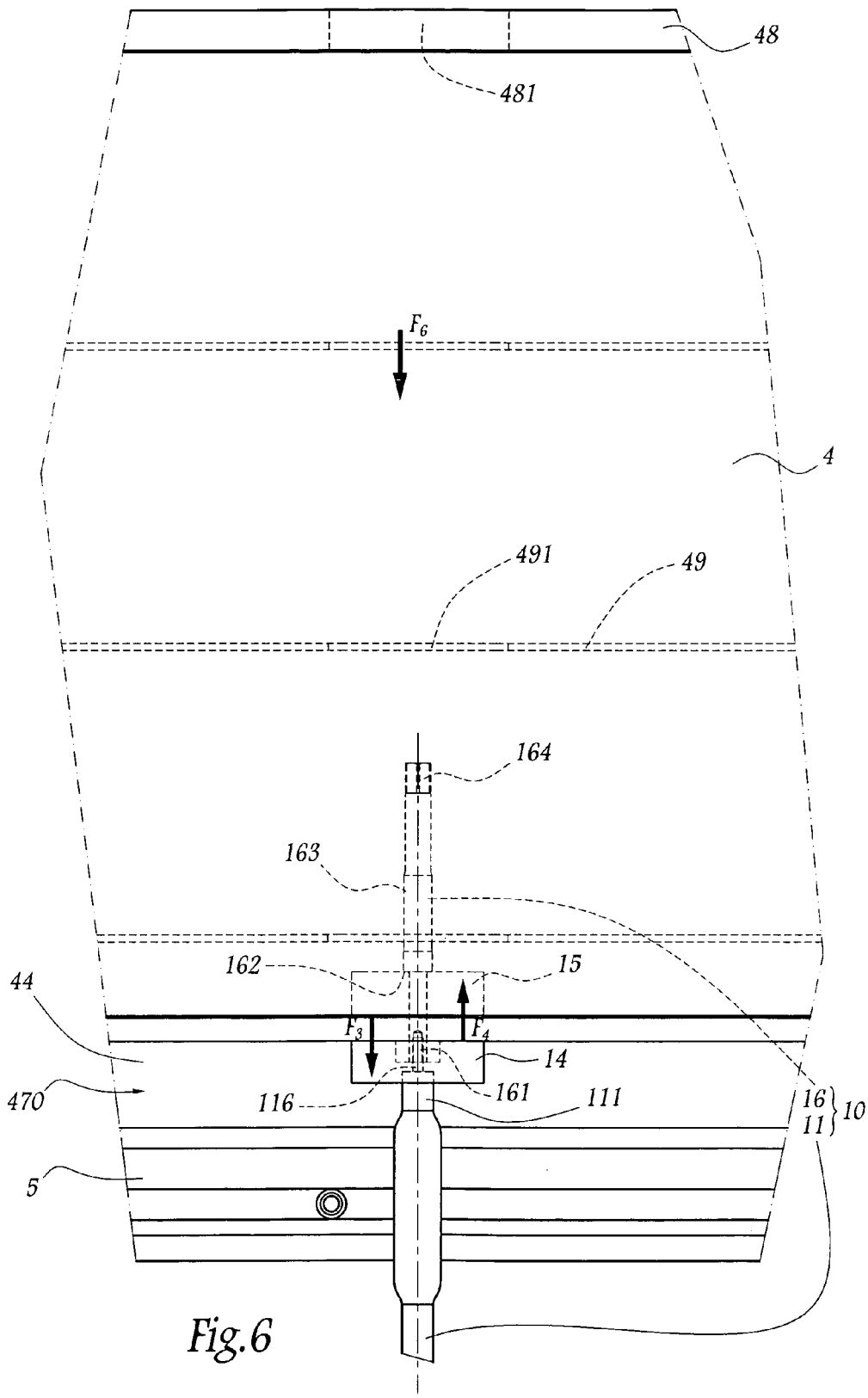
FIG. 6 is a view analogous to FIG. 3 for a frame constituting a second embodiment of the invention.

In the second embodiment of the invention as shown in FIG. 6, elements analogous to elements in the first embodiment are given identical references. The rod 11 of the brace 10 in this embodiment is similar to that in the first embodiment. It differs therefrom insofar as its end 111 is not tapped, but is provided with an end thread 116. An analogous thread is provided at the other end of the rod 11 (not shown).

A plate 14 is welded to the end 111, the thread 116 projecting beyond said plate. An identical plate is welded to the other end of the rod 11.

A blind nut 16 is provided for being screwed onto the thread 116. To this end, it is provided with tapping 161 that is complementary to the thread 116, the tapped portion being extended by a non-tapped portion 163, with a shoulder 162 being formed between these portions. Away from the tapping 161, the portion 163 is terminated by a drive head 164.

A plate 15 analogous to that of the first embodiment is placed around the tapped portion of the nut 16 whose outside surface is cylindrical with a circular generator line. The plate 15 receives the shoulder 162 bearing thereagainst.

A similar nut (not shown) is provided for screwing onto the thread at the end of the rod 11 that is not shown. This nut is likewise fitted with a plate analogous to the plate 15.

The extrusion constituting the cross-rail 4 is of a shape such that a receiver hollow 470 corresponding to the opening 47 is created over the entire length of the extrusion. In other words, there is no need to machine away the portions surrounded by the chain-dotted line T in FIG. 5, thus making the heddle frame easier to manufacture.

The nut 16 does not extend over the full height of the extrusion constituting the cross-rail 4, but over a fraction only thereof, this nut being drivable via its head 164 by inserting a tool in the direction of arrow $F_6$ through an opening 481 formed in the edge 48 of the cross-rail 4 remote from the tab 44 that supports the heddle-carrying bar 5.

As before, the plate 15 associated with the nut 16 and the plate 14 held stationary on the end 111 of the rod 11 enables a locking or clamping force $F_3$+$F_4$ to be inserted on an internal portion 45 of the cross-rail 4.

This embodiment presents the advantage of enabling the brace 10 to be positioned anywhere along the length of the cross-rail 4, providing the opening 481 has been made, together with openings 491 in alignment with the opening 481 and formed through the splines 49 inside the cross-rail 4.

In a variant of the invention that is not shown but that is applicable to both of the embodiments described above, the facing projections 45 and 46 may form portions of a web internal to the cross-rail 4, this web then being pierced to pass the threaded end 121 of the screw 12. The same structure should then be adopted for the bottom cross-rail 4'.

Similarly, in a variant, a projection or a web portion may be provided solely in the vicinity of one of the partitions 42 or 43.

In another variant of the invention that is not shown, the plate 15 may be omitted, the shoulder 122 of the screw 12 then bearing directly against the web or the projections belonging to the extrusion constituting the cross-rail 4.

The technical characteristics of the various embodiments described above may be combined with one another in the context of the present invention. In particular, the nuts 16 may project from the cross-rails through the openings 481, like the screw 12 in the first embodiment. Similarly, the screws 12 may be received completely inside the cross-rails, like the nuts 16 in the second embodiment.

The invention claimed is:

1. A heddle frame for a loom, said frame comprising two uprights and two cross-rails interconnected by at least one brace which extends in a direction that is generally parallel to said uprights, said brace including:

a rod having screw fastener means provided at opposite ends thereof;

two threaded members adapted to be screwed onto said opposite ends of said rod by co-operating with said screw fastener means; and first and second clamping means provided adjacent said opposite ends of said rod and being urged by said two threaded members, respectively, which exert oppositely directed locking forces ($F_3$, $F_4$) on a portion of said cross-rails, wherein said locking forces are a result of screwing said two threaded members onto a corresponding of said opposite ends of said rod.

2. The frame according to claim 1, wherein said screw fastener means are tapped holes, and wherein said threaded members are screws.

3. The frame according to claim 1, wherein said screw fastener means are screw threads, and wherein said threaded members are nuts.

4. The frame according to claim 1, wherein said portion of said cross-rails is at least one projection inside each of said cross-rails.

5. The frame according to claim 4, wherein each projection extends over substantially an entire length of said cross-rail.

6. The frame according to claim 1, wherein said portion of cross-rails is accessible from a side of each cross-rail that faces toward an opposite cross-rail, via an opening formed in at least one external partition of each cross-rail.

7. The frame according to claim 1, wherein said first clamping means for exerting a locking force include, at each of said opposite ends of said rod, first clamping plates adapted to be pushed by said rod against said portion of said cross-rails, and said second clamping means includes second clamping plates adapted to be pushed by corresponding threaded members against said portion of said cross-rails, and wherein said portion of each of said cross-rails is disposed between said first and second clamping plates.

8. The frame according to claim 7, wherein said first clamping plates are secured to said opposite ends of said rod.

9. The frame according to claim 8, wherein said portion of each of said cross-rails is accessible from a side of each cross-rail that faces toward an opposite cross-rail, via an opening formed in at least one external partition of each cross-rail, each opening is formed on one side only of each cross-rail, wherein a zone for receiving one of said opposite ends of said rod is bordered by a tab forms a part of said cross-rail, and wherein a half-length of said first clamping plate is greater than a distance between said tab and a central axis of said screw fastener means of said one of said opposite ends.

10. The frame according to claim 1, wherein said first and second clamping means are adjustable in a direction parallel to a longitudinal direction of a corresponding cross-rail.

11. The frame according to claim 1, wherein said rod is provided with at least one offset portion formed around a heddle-carrier bar.

12. The frame according to claim 1, wherein each threaded member extends to an outside of a cross-rail on which said threaded member is mounted, wherein an opening is formed in an edge of said cross-rail that is remote from an opposite cross-rail, and wherein a lining is fitted on the opposite cross-rail in the vicinity of said opening, said lining being adapted to prevent said threaded member from moving in at least one direction perpendicular to a longitudinal axis of said threaded member.

13. The frame according to claim 1, wherein said threaded members do not project outside said cross-rails when said threaded members have been tightened, and wherein said members are accessible through openings formed in said cross-rails.

14. The frame according to claim 1, wherein a height of each cross-rail is greater than a travel stroke of said frame.

15. A loom comprising, at least one heddle frame, said at least one heddle frame, including two uprights and two cross-rails interconnected by at least one brace which extends in a direction that is generally parallel to said uprights, said brace including:

a rod having a screw fastener means provided at opposite ends thereof;

two threaded members adapted to be screwed onto said opposite ends of said rod by co-operating with said screw fastener means; and first and second clamping means provided adjacent said opposite ends of said rod and being urged by said two threaded members, respectively, which exert oppositely directed locking forces ($F_3$, $F_4$) on a portion of said cross-rails, wherein said locking forces are a result of screwing one of said members onto a corresponding of said opposite ends of said rod.

16. The frame according to claim 1, wherein said portion of said cross-rails is a web inside said cross-rails.

17. The frame according to claim 16, wherein each web extends over substantially an entire length of each cross-rail.

18. The frame according to claim 1, wherein said locking forces are pinching forces.

19. The frame according to claim 1, wherein said locking forces are exerted on two projections of each of said cross-rails, and wherein at least a portion of each of said threaded members is engaged between said projections.

* * * * *